US006312140B1

(12) United States Patent
McGuire

(10) Patent No.: US 6,312,140 B1
(45) **Date of Patent: *Nov. 6, 2001**

(54) TRACK ASSEMBLY FOR UTILITY LIGHT

(76) Inventor: John W. McGuire, 121 W. North St., #28, Waukesha, WI (US) 53214

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/464,105

(22) Filed: Dec. 16, 1999

(51) Int. Cl.[7] ..... F21S 8/02

(52) U.S. Cl. ..... 362/250; 362/285; 362/418; 362/249; 362/404

(58) Field of Search ..... 362/147, 396, 362/404, 430, 250, 287, 418, 285

(56) References Cited

U.S. PATENT DOCUMENTS 4,032,775 * 6/1977 Bobrick et al. ..... 362/404
4,441,145 * 4/1984 Antkowiak ..... 362/384
4,975,817 * 12/1990 Reimers ..... 362/418
5,128,847 * 7/1992 Lin et al. ..... 362/226

* cited by examiner

*Primary Examiner*—Thomas M. Sember
(74) *Attorney, Agent, or Firm*—Joseph S. Heino

(57) ABSTRACT

A track and a track assembly is surface mounted to a ceiling and extends longitudinally in front of a number of adjacent apartment or condominium storage compartments. The track assembly includes a trolley which is travelable along the track and which includes cooperating friction brakes. The friction brakes allow the trolley to be fixed in any location along the track. Suspended from the trolley is an extendable and retractable utility light fixture. Also attached to the trolley is a recoiled electrical connection and a pull cord for manually moving the trolley and suspended utility light fixture along the length of the track.

6 Claims, 2 Drawing Sheets

10
11
12
13
15
16
7
20
22
9
6
3
35
33
36
31
41
42
38
39
34
32
23
51
52
53
54
55

TRACK ASSEMBLY FOR UTILITY LIGHT

FIELD OF THE INVENTION

This invention relates generally to lights and light fixtures. More specifically, it relates to a track and a track assembly which is used in conjunction with a retractable utility light which allows for slidable movement of the retractable utility light along the track assembly and which allows for a greater area of usage for the retractable utility light.

BACKGROUND OF THE INVENTION

The use in light fixtures is well known. The use of retractable utility lights is also well known. Such fixtures and lights allow illumination in almost any place and under almost any conditions, as long as there is an electrical source nearby which can be used to energize the fixture or light. In the experience of this inventor, one area where light fixtures are particularly useful is in providing illumination along a row of condominium or apartment storage compartments which are located in a common area in that condominium or apartment complex. Also in the experience of this inventor, stationary light fixtures are sparsely used in such circumstances and, where used at all, are not particularly useful to the person attempting to carefully examine the contents of his or her apartment or condominium storage compartment. Oftentimes, the stationary light fixture is not located directly in front of the compartment or it is not located close enough to the storage compartment to allow for adequate or direct illumination of the contents. Understandably, the economics of light fixture placement by the condominium or apartment owner does not always allow for the placement of such adequate or direct lighting.

SUMMARY OF THE INVENTION

Accordingly, it is an object of the present invention to provide a new, useful and uncomplicated device which allows a single electrical outlet to be utilized with a retractable utility light for illuminating a plurality of condominium or apartment storage compartments. It is a further object of this invention to provide such a device which requires only a minimal number of elements and which requires a minimal number of steps to utilize. It is yet another object of this invention to provide such a device which is readily and quickly usable with existing electrical boxes which are located in an existing condominium or apartment compartment storage area.

The present invention has obtained these objects. It provides for a track and a track assembly which is surface mounted to a ceiling and which extends longitudinally in front of a number of adjacent apartment or condominium storage compartments. The track assembly includes a trolley which is travelable along the track and which includes cooperating friction brakes. The friction brakes allow the trolley to be fixed in any location along the track. Suspended from the trolley is an extendable and retractable utility light fixture. Also attached to the trolley is a recoiled electrical connection and a pull cord for manually moving the trolley and suspended utility light fixture along the length of the track. The foregoing and other features of the device of the present invention will be further apparent from the detailed description which follows.

DETAILED DESCRIPTION

Figures 1, 2, 3:
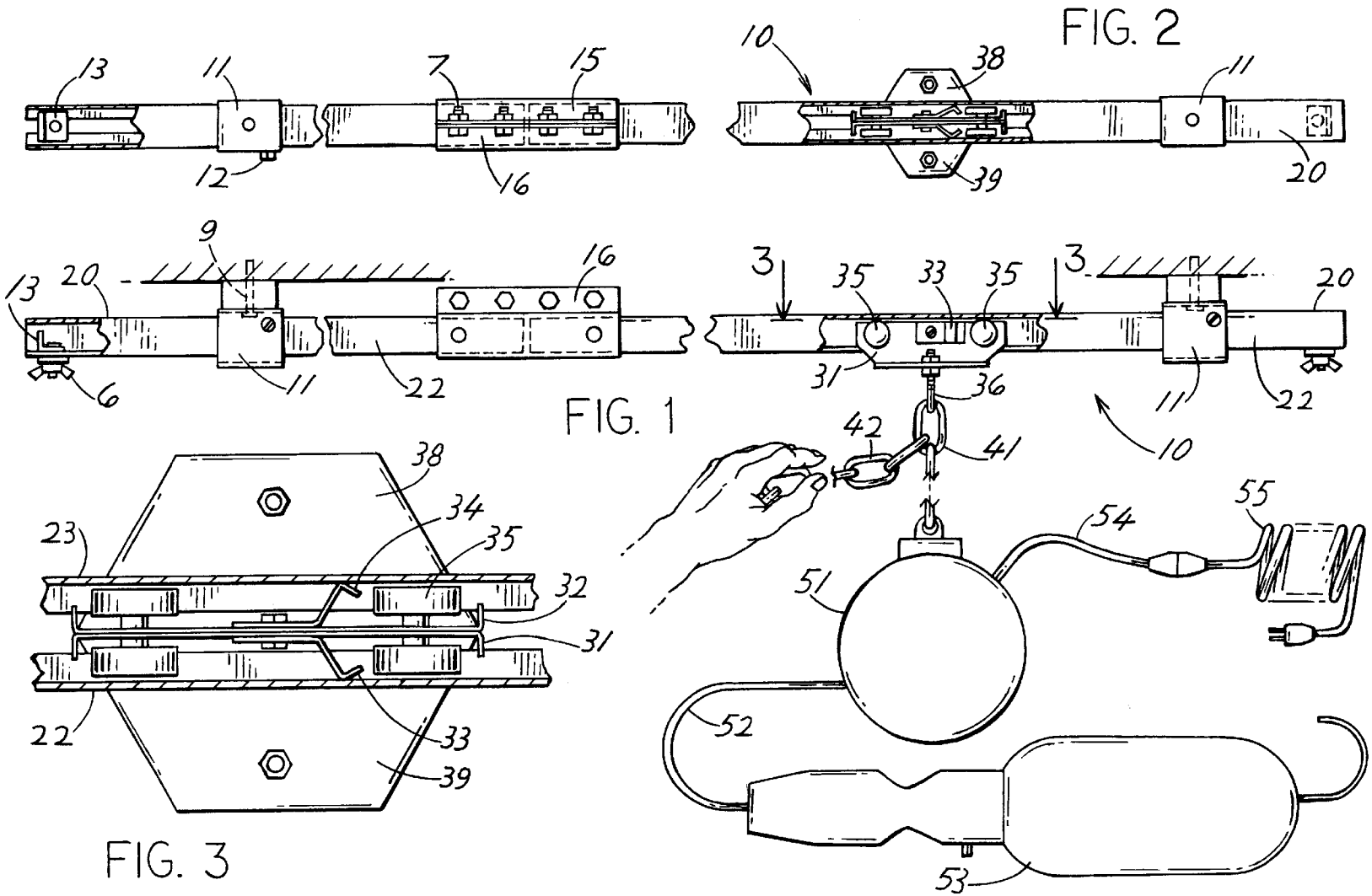
FIG. 1 is a left side elevational view of a device constructed in accordance with the present and showing the track assembly mounted to a ceiling or other horizontal surface.
FIG. 2 is a top plan view of the track portion of the track assembly shown FIG. 1.
FIG. 3 is an enlarged top cross-sectional view of the trolley portion of the present invention taken along line 3—3 in FIG. 1 and showing the details of the trolley.
Figures 4, 5:
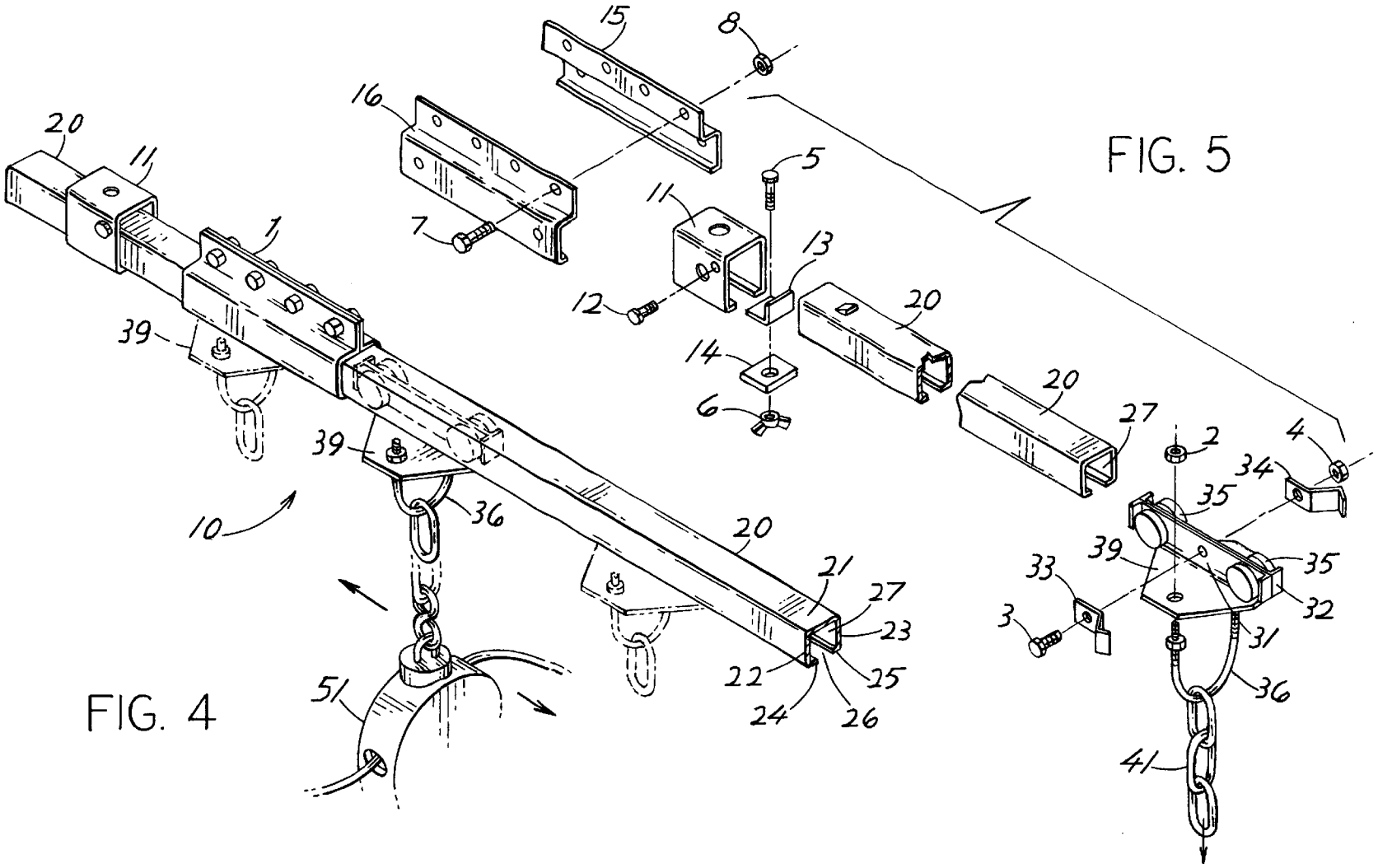
FIG. 4 is a front and left side perspective view of a portion of the track shown FIGS. 1 and 2.
FIG. 5 is an exploded view of the track portion shown in FIG. 4 and showing the detail of the elements thereof.

Referring now to the drawings in detail, FIG. 1 shows a preferred embodiment of the device of the present invention. The device includes a track assembly, generally identified 10. The track assembly 10 includes a plurality of track sections 20. Although only two track sections 20 are shown, it is to be understood that any number of track sections 20 could be longitudinally aligned to form a track continuum and still come within the scope of this invention. The track sections 20 are connected together by means of a track coupler 1. The track coupler 1 includes a first coupler member 15 and a second coupler member 16. The first coupler member 15 and the second track member 16 are fastened together by means of a plurality of bolts 7 and nuts 8. See FIG. 5. The coupler members 15, 16 essentially wrap around the ends of adjacent track sections 20 but leave a gap or slot (not shown) at the underside of the track sections 20. The significance of this gap or slot will be further apparent later in this detailed description.

The track sections 20, together with the track coupler 1, are mounted to a ceiling or to the underside of another horizontal surface by means of a plurality of track hangers 11. See FIG. 5. Again, while only two track hangers 11 are shown in the preferred embodiment as disclosed, it is to be understood that any number of such track hangers 11 may be used with the track assembly 10 and still come within the scope of this invention. The track hangers 11 utilize bolts 9 or other fasteners to effect the attachment of the track assembly 10 to a ceiling or other horizontal surface. As was true with the track coupler 1, each track hanger 11 includes an opening at its underside (see FIG. 5) the significance of which will become apparent further in this detailed description.

Another accessory included in this track assembly 10 is a stop member 13 located at the opposing ends of the track sections 20. The stop member 13 also includes a fastening plate 14, a fastening bolt 5 and a wing nut 6 for fastening the stop member 13 within the track section 20. See FIG. 5. The purpose and function of the stop member 13 will also become further apparent later in this detailed description.

The track sections 20 are similarly configured to consist of a top wall or surface 21, a first side wall 22 and a second side wall 23. The top and side walls 21, 22, 23, each of which is a longitudinally extending surface, define a generally c-shaped elongate cavity or channel 27. Each side wall 22, 23 carries an inwardly directed flange 24, 25, respectively. The inwardly directed flanges 24, 25 define an opening or aperture 26 within the track section 20 which opens from beneath the track section 20 via the slot 26. See FIGS. 4 and 5. As previously disclosed, the track coupler 1 and the track hangers 11 likewise conform to this general shape and allow for this slot continuum along the bottom of the track assembly 10.

Located within and moveable along the internal channel 27 of each of the track sections 20 is a trolley 30. The trolley 30 includes a first trolley member 31 and a second trolley member 32. The first and second trolley members 31, 32 are fastened together and further include four trolley wheels 35 which ride along and on top of the inwardly directed flanges 24, 25 of the track sections 20. The first and second trolley members 31, 32 further include and are connected to trolley hanger members 38, 39, respectively, which extend through the track assembly slot 26 and form a flat surface at the bottom of the trolley 30. The flat surface formed by the hanger members 38, 39 is situated completely outside the track section 20. The trolley 30 further includes a pair of friction brake elements 33, 34 fastened to the trolley members 31, 32 by means of a bolt 3 and nut 4. The purpose and function of the friction brake elements 33, 34 will be further apparent later in this detailed description. Attached to the under surface of the trolley hanger members 38, 39 is a hanger mechanism 36 which, in the preferred embodiment of the present invention, takes the form of a U-bolt. The hanger mechanism 36 or U-bolt is fastened by use of hanger bolts 2. The hanger mechanism 36 is connected to one end of a suspension chain 41 or other secure and suitable connection means. The opposite end of the chain 41 or connection means is attached to a standard retractable utility light fixture 51. The retractable utility light fixture 51 includes a cord recoiling mechanism and a light member 53. Electrical power is provided to the fixture 51 by means of a coiled electrical cord 55. The electrical cord 55 has "memory" such that the tendency of the cord 55 is to keep itself coiled, even after full or near full extension. Also attached to the hanger mechanism 36 is a pull chain 42 or other suitable pull mechanism. It is contemplated by this inventor that the pull chain 42 of the present invention may be fabricated of a light-weight but strong plastic material for safety reasons. It could also be constructed of a nylon cord or some other strong material.

In application, the plug end of the electrical cord 55 is attached to a typical electrical receptacle which is situated at or near the track assembly 10. The user grasps the pull chain 42 and urges the trolley 30 along the track sections 20 to the point desired or required. While it would appear that the trolley 30 would, after moved into position, freely move back along the track sections 20 due to the recoil effect of the electrical cord 55, the presence of the friction brakes 33, 34 as part of the trolley 30 prevents such free movement. In fact, the presence of the friction brakes 33, 34 allows the trolley 30 to be moveable along the entire length of the track sections 20 and well away from the electrical receptacle. The friction brakes 33, 34 of the trolley 30 do not, however, allow the built-in "memory" of the electrical cord 55 to overcome the friction force they apply to the inner surfaces of the track side walls 22, 23. Accordingly, the trolley 30 will, in effect, be movable only by the force exerted by the user on the pull cord 42. Only the force of the user applied to the pull chain 42 is sufficient to re-locate the trolley 30 along the track assembly 10.

From the foregoing detailed description of the illustrative embodiment of the invention set forth herein, it will be apparent that there has been provided a new, useful and uncomplicated device which allows a single electrical outlet to be utilized with a retractable utility light for illuminating a plurality of condominium or apartment storage compartments; which requires only a minimal number of elements and which requires a minimal number of steps to utilize; and which provides such a device which is readily and quickly usable with existing electrical boxes which are located in an existing condominium or apartment compartment storage area.

The principles of this invention having been fully explained in connection with the foregoing, I hereby claim as my invention:

1. A track assembly to be used in proximity to an electrical power outlet for providing an electrical light source in the area of the outlet which comprises a longitudinally extending track, said track having a top wall and two side walls defining a generally C-shaped elongate channel, each side wall carrying an inwardly directed and longitudinally extending flange, means for suspending said track over head, a trolley, said trolley being functionally adapted to be retained within and movable along the channel of said track, a retractable utility light fixture, said light fixture including a recoiled power cord having one end which is engageable with said electrical power outlet and further including an electrical light source, means for suspending said retractable utility light fixture from said trolley, and means for applying a continuous and constant frictional force between said trolley and said track channel whereby the position of the trolley along said track channel is changed only when said frictional force is overcome, said frictional force applying means including a pair of strips formed into a generally V-shape with said V-shape comprised of a top open portion and a closed bottom portion with said bottom closed portion of said V-shape being formed by attaching the strips in juxtaposed fashion relative to said trolley and the top portion of said V-shape fitting inside said track side walls so that the strip portion at the top of said V-shape provides consistent and constant pressure against said track side walls.

2. The track assembly of claim 1 wherein said pair of strips are formed of a resilient material.

3. The track assembly of claim 2 wherein said pair of resilient strips are formed of a metal material.

4. A track assembly to be used in proximity to an electrical power outlet for providing an electrical light source in the area of the outlet which comprises a longitudinally extending track, said track having a top wall and two side walls defining a generally C-shaped elongate channel, each side wall carrying an inwardly directed and longitudinally extending flange, means for suspending said track over head, a trolley, said trolley being functionally adapted to be retained within and movable along the channel of said track, said trolley including a trolley body, said trolley body having at least two outer trolley body surfaces juxtaposed relative to said track side walls, a retractable utility light fixture, said light fixture including a recoiled power cord having one end which is engageable with said electrical power outlet and further including an electrical light source, means for suspending said retractable utility light fixture from said trolley, and means for applying a continuous and constant frictional force between said trolley and said track channel whereby the position of the trolley along said track channel is changed only when said frictional force is overcome, said frictional force applying means including a pair of strips formed into a generally V-shape with said V-shape comprised of an open top portion and a closed bottom portion with said bottom closed portion of said V-shape being formed by attaching one strip to each outer trolley body surface and the open top portion of said V-shape fitting inside said track side walls so that the strip portion at the top of said V-shape provides consistent and constant pressure against said track side walls.

5. The track assembly of claim 4 wherein said pair of strips are formed of a resilient material.

6. The track assembly of claim 5 wherein said pair of resilient strips are formed of a metal material.

* * * * *